US011516890B2

(12) United States Patent
Cadima

(10) Patent No.: US 11,516,890 B2
(45) **Date of Patent: *Nov. 29, 2022**

(54) COOKTOP APPLIANCE AND HEATING ELEMENT HAVING A THERMALLY ISOLATED THERMOSTAT

(71) Applicant: Haier US Appliance Solutions, Inc., Wilmington, DE (US)

(72) Inventor: Paul Bryan Cadima, Crestwood, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/099,110

(22) Filed: Nov. 16, 2020

(65) Prior Publication Data

US 2022/0159790 A1 May 19, 2022

(51) Int. Cl.
*H05B 3/74* (2006.01)
*F24C 15/10* (2006.01)
*H05B 3/76* (2006.01)

(52) U.S. Cl.
CPC ..... *H05B 3/746* (2013.01); *F24C 15/105* (2013.01); *H05B 3/76* (2013.01); *H05B 2213/04* (2013.01)

(58) Field of Classification Search
CPC ..... F24C 7/067; F24C 7/088; F24C 15/101; F24C 15/102; F24C 15/105; F24C 15/106; F24C 15/108; F24C 15/36; H05B 3/68; H05B 3/72; H05B 3/746; H05B 3/748; H05B 3/76; H05B 1/0208; H05B 1/0213; H05B 1/0219; H05B 1/0266
USPC ..... 219/443.1–468.2
See application file for complete search history.

(56) References Cited

U.S. PATENT DOCUMENTS

| | | | | |
|---|---|---|---|---|
| 3,041,437 | A * | 6/1962 | Carissimi | H05B 1/0213 219/448.16 |
| 6,246,033 | B1 | 6/2001 | Shah | |
| 10,634,363 | B2 | 4/2020 | Gomez et al. | |
| 2018/0238559 | A1 | 8/2018 | Pasqual et al. | |

FOREIGN PATENT DOCUMENTS

| | | |
|---|---|---|
| CN | 1133435 A | 10/1996 |
| CN | 2395170 Y | 9/2000 |

* cited by examiner

*Primary Examiner* — Hung D Nguyen
(74) *Attorney, Agent, or Firm* — Dority & Manning, P.A.

(57) ABSTRACT

A cooktop appliance or heating coil assembly may include a heating element, a shroud cover, a thermostat, and a spring bracket. The shroud cover may be disposed within the heating element. The shroud cover may include a top wall defining an upper surface and a lower surface. The thermostat may extend vertically between a distal end and an interior end below the distal end. The distal end may be disposed against the shroud cover at the lower surface. The thermostat may be connected in series between the first and second coil sections of the spiral wound sheathed heating element. The spring bracket may be disposed against the shroud cover at the lower surface and bias the shroud cover upward.

20 Claims, 12 Drawing Sheets

COOKTOP APPLIANCE AND HEATING ELEMENT HAVING A THERMALLY ISOLATED THERMOSTAT

FIELD OF THE INVENTION

The present subject matter relates generally to electric heating elements for appliances, such as for cooktop or range appliances.

BACKGROUND OF THE INVENTION

Cooking appliances that include a cooktop traditionally have at least one heating element (e.g., electric coil heating element) positioned on a panel proximate a cooktop surface for use in heating or cooking an object, such as a cooking utensil, and its contents. Recent regulatory requirements mandate that electric coil heating elements on cooktop appliances be incapable of heating cooking oil to an oil ignition temperature. Thus, certain electric coil heating elements utilize a bimetallic thermostat to interrupt power to the coil when the thermostat reaches a tripping point. In some cooktops, the thermostat is remotely positioned from the utensil or cookware and infers the cookware temperature through correlation. In other cooktops, the thermostat contacts a bottom of the cookware to improve correlation. However, whether remotely positioned from the cookware or contacting the cookware, imperfect correlation requires conservative thermostat calibrations and thus results in reduced performance.

Known coil heating elements using bimetallic thermostats have shortcomings. In particular, the flatness of the coil has a significant impact to system performance, as does the flatness of the bottom of the cookware. Poor contact between the cookware and the coil cause the portions of the coil that have poor conduction to the cookware to glow red hot and radiate heat. Radiative heat transfer from the coil to the thermostat can overcome the heat transfer from the cookware to the thermostat, causing the thermostat to trip early.

As a result, it would be useful to have a cooktop appliance addressing one or more of the above identified issues. In particular, it may be advantageous to provide a cooktop appliance having a thermostat with one or more features for enhancing contact (e.g., with a utensil on a heating element) or conductive heat transfer from a utensil to a thermostat without being unduly affected by radiative heat transfer from the heating element. Additionally or alternatively, it may be advantageous to provide a cooktop appliance having a thermostat with one or more features for enhancing contact (e.g., with a utensil on a heating element) or conductive heat transfer from a utensil to a thermostat while providing for a robust and relatively easy to assemble system.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, an electric resistance heating coil assembly is provided. The electric resistance heating coil assembly may include a spiral would sheathed heating element, a shroud cover, a thermostat, and a spring bracket. The spiral wound sheathed heating element may have a first coil section and a second coil section. The shroud cover may be disposed radially inward from the first and second coil sections. The shroud cover may include a top wall defining an upper surface and a lower surface. The thermostat may extend vertically between a distal end and an interior end below the distal end. The distal end may be disposed against the shroud cover at the lower surface. The thermostat may be connected in series between the first and second coil sections of the spiral wound sheathed heating element. The spring bracket may be disposed against the shroud cover at the lower surface and bias the shroud cover upward.

In another exemplary aspect of the present disclosure, a cooktop appliance is provided. The cooktop appliance may include a heating element and a sensor support assembly positioned within a heating zone of the heating element. The sensor support assembly may include a shroud cover, a thermostat, and a spring bracket. The shroud cover may include a top wall defining an upper surface to contact a cooking utensil and a lower surface disposed opposite of the upper surface. The thermostat may be fixed relative to the shroud cover below the upper surface. The spring bracket may be disposed against the shroud cover at the lower surface and bias the shroud cover upward.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
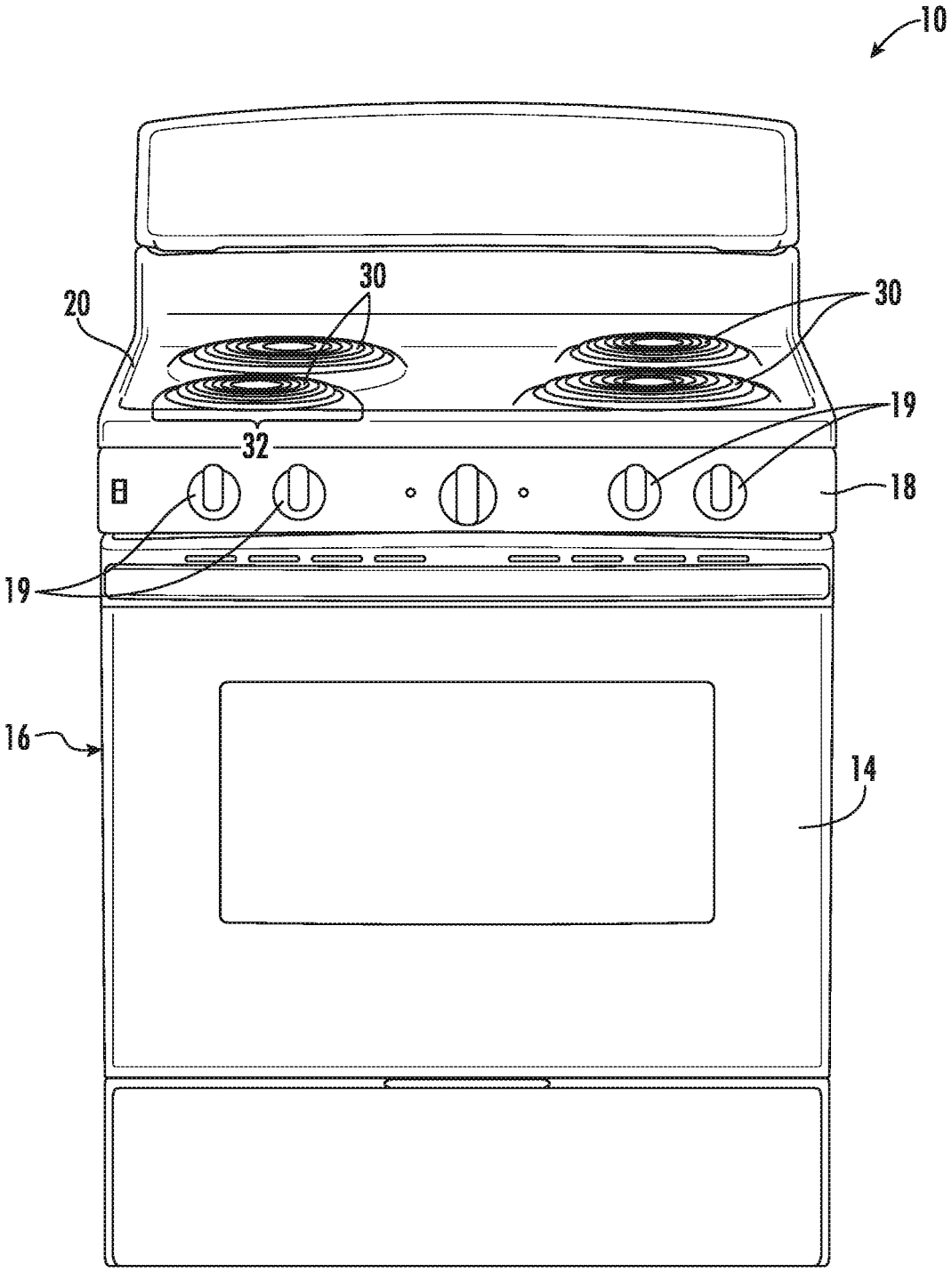
FIG. 1 provides a front perspective view of a range appliance according to exemplary embodiments of the present disclosure.
Figure 2:
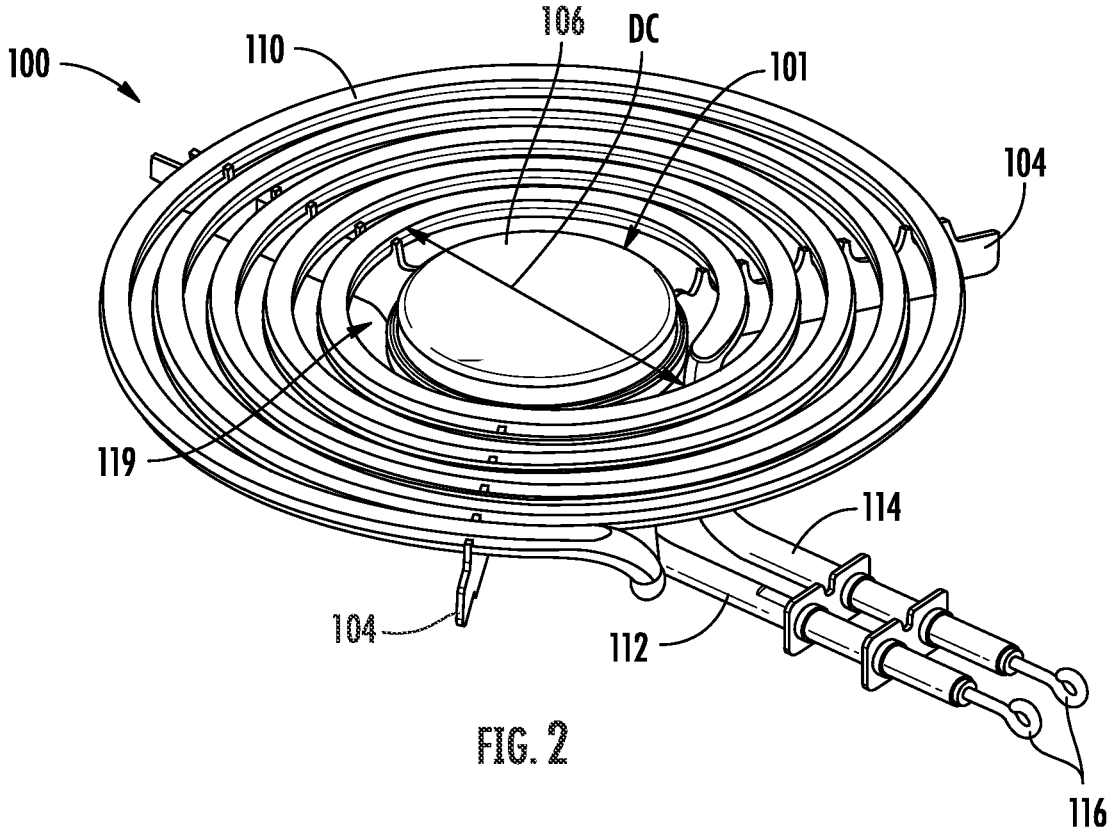
FIG. 2 provides a top perspective view of an electric resistance heating coil assembly of the exemplary range appliance of FIG. 1.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "or" is generally intended to be inclusive (i.e., "A or B" is intended to mean "A or B or both"). The terms "first," "second," and "third" may be used interchangeably to distinguish one component from another and are not intended to signify location or importance of the individual components.

Turning now to the figures, FIG. 1 provides a front, perspective view of a range appliance 10 according to exemplary embodiments of the present disclosure. Range appliance 10 is provided by way of example only and is not intended to limit the present subject matter to the particular arrangement shown in FIG. 1. Thus, the present subject matter may be used with other cooktop appliance configurations (e.g., double oven range appliances, standalone cooktop appliances, etc.).

Generally, a top panel 20 of range appliance 10 includes one or more heating elements 30. Heating elements 30 may be, for example, electrical resistive heating elements. Range appliance 10 may include only one type of heating element 30, or range appliance 10 may include a combination of different types of heating elements 30, such as a combination of electrical resistive heating elements and gas burners. Further, heating elements 30 may have any suitable shape and size, and a combination of heating elements 30 of different shapes and sizes may be used.

Generally, each heating element 30 defines a heating zone 32 on which a cooking utensil, such as a pot, pan, or the like, may be placed to cook or heat food items placed in the cooking utensil. In some embodiments, range appliance 10 also includes a door 14 that permits access to a cooking chamber 16 of range appliance 10 (e.g., for cooking or baking of food items therein). A control panel 18 having controls 19 permits a user to make selections for cooking of food items—although shown on a front panel of range appliance 10, control panel 18 may be positioned in any suitable location. Controls 19 may include buttons, knobs, and the like, as well as combinations thereof. As an example, a user may manipulate one or more controls 19 to select a temperature or a heat or power output for each heating element 30.

Figure 3:
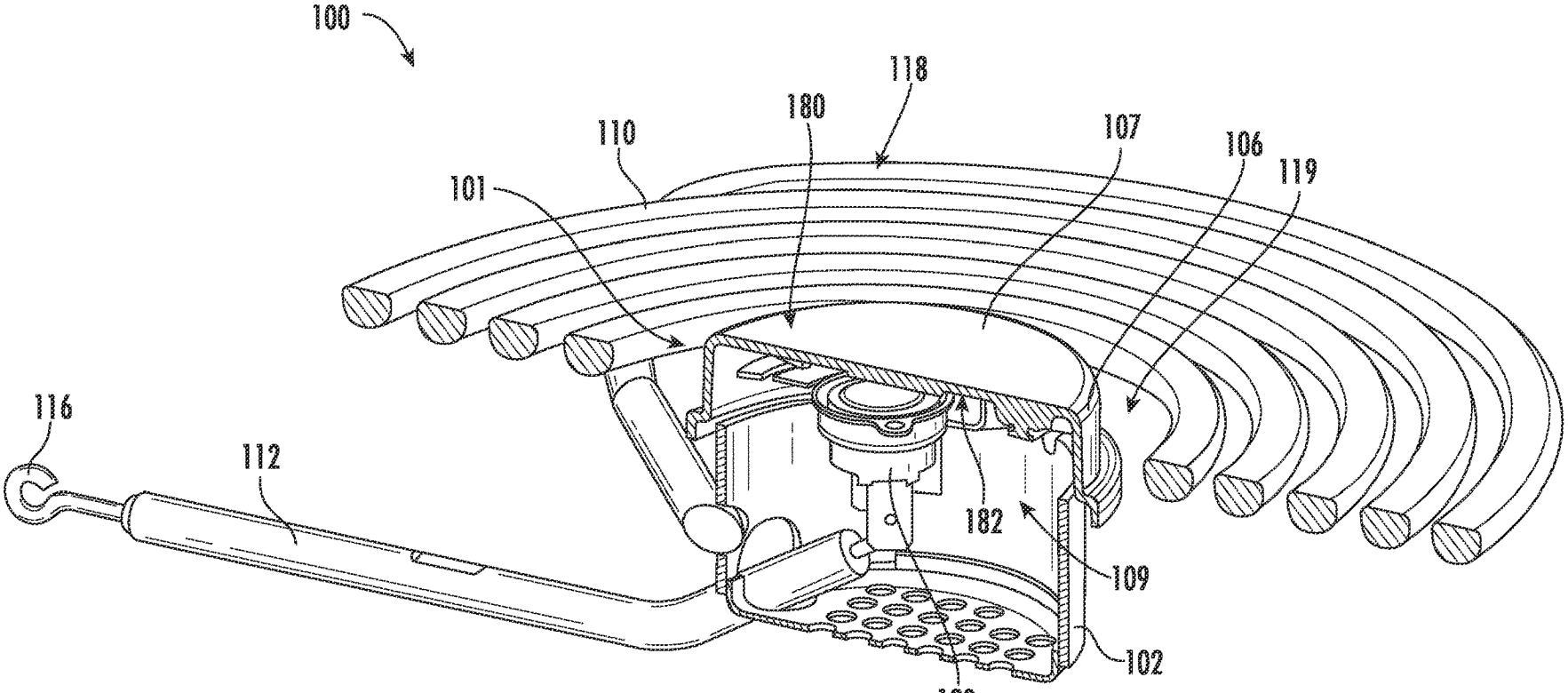
FIG. 3 provides a sectional perspective view of an electric resistance heating coil assembly according to exemplary embodiments of the present disclosure.
Figure 4:
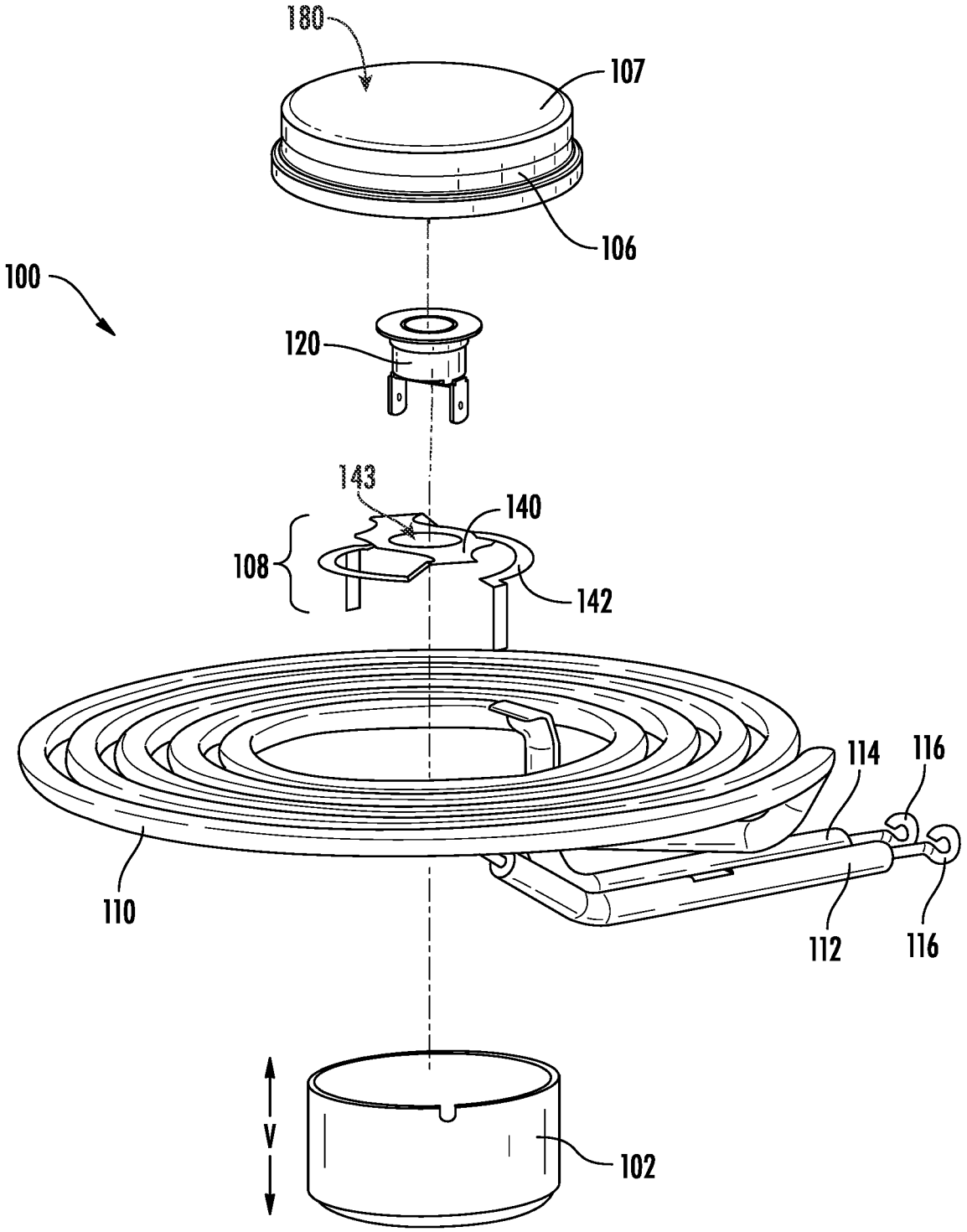
FIG. 4 provides an exploded top perspective view of a portion of the exemplary heating coil assembly of FIG. 3.
Figure 5:
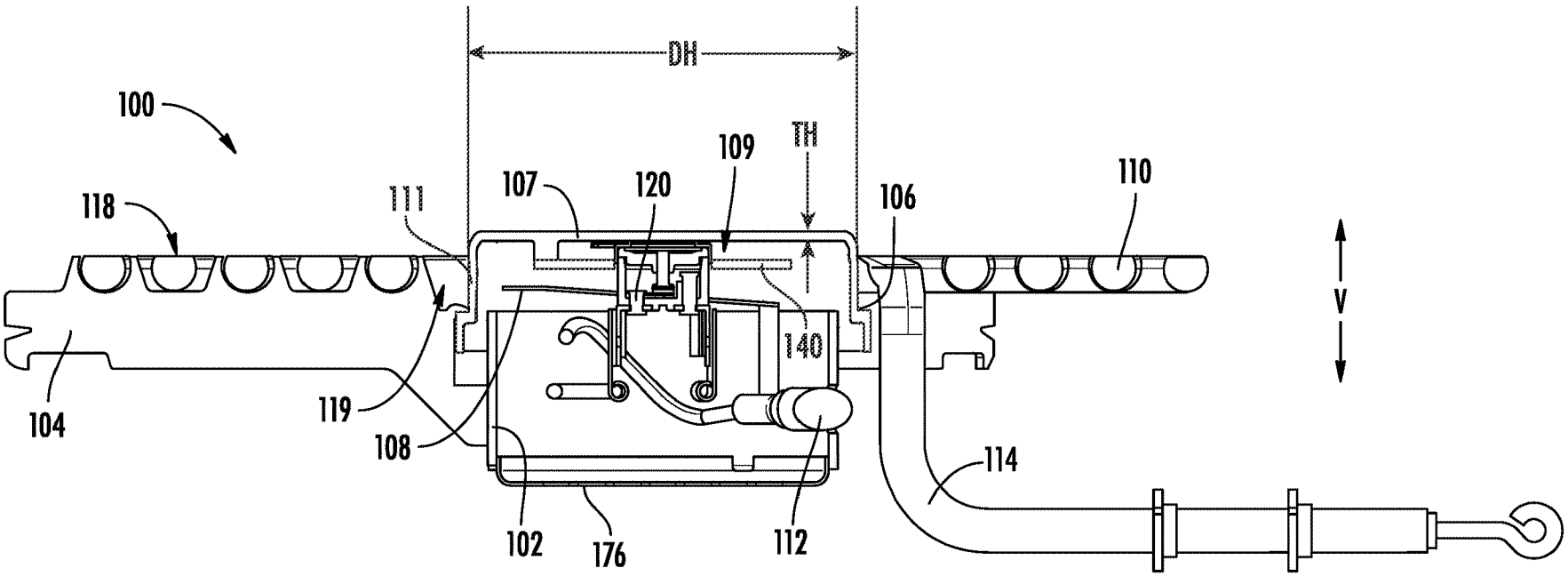
FIG. 5 provides a sectional elevation view of the exemplary electric resistance heating coil assembly of FIG. 3.
Figure 6:
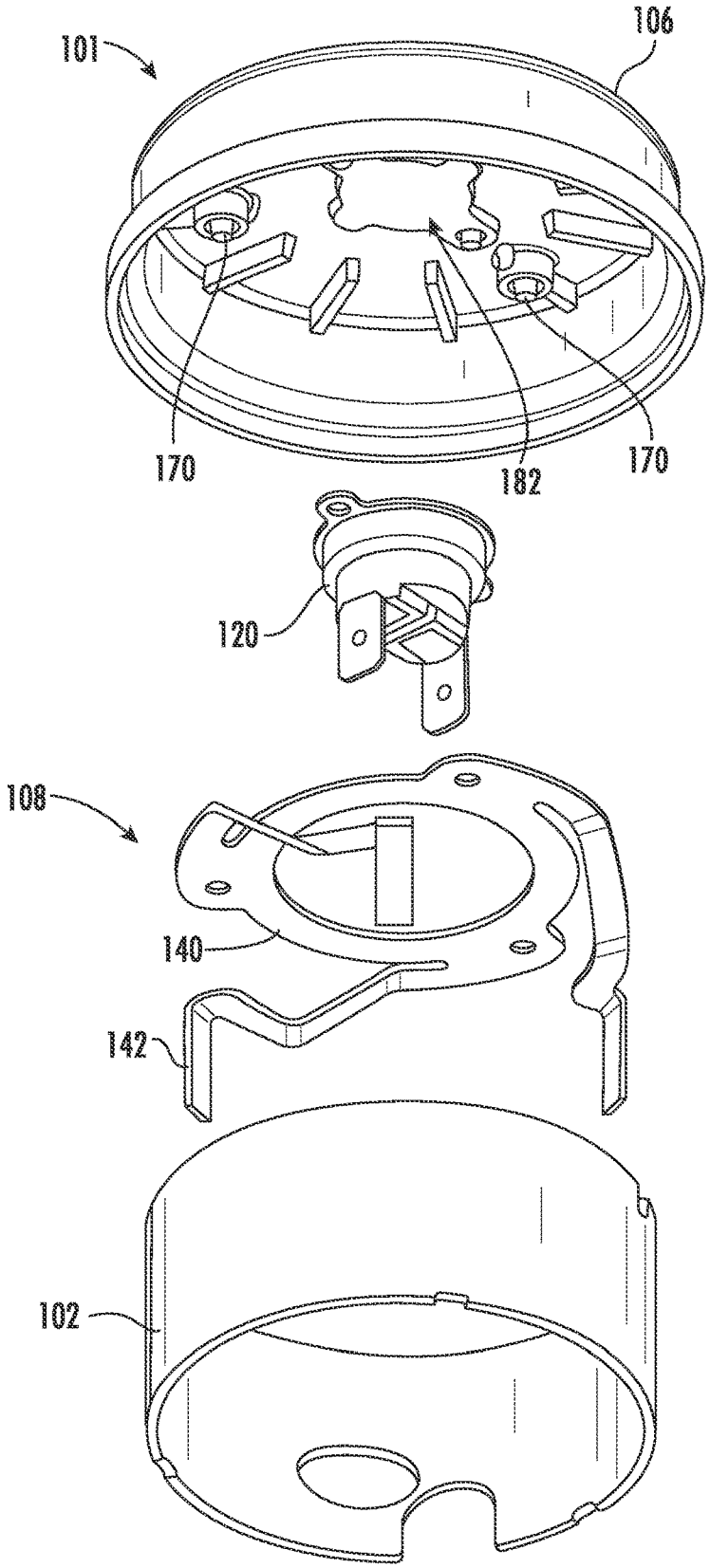
FIG. 6 provides an exploded bottom perspective view of a portion of the exemplary heating coil assembly of FIG. 3.
Figure 7:
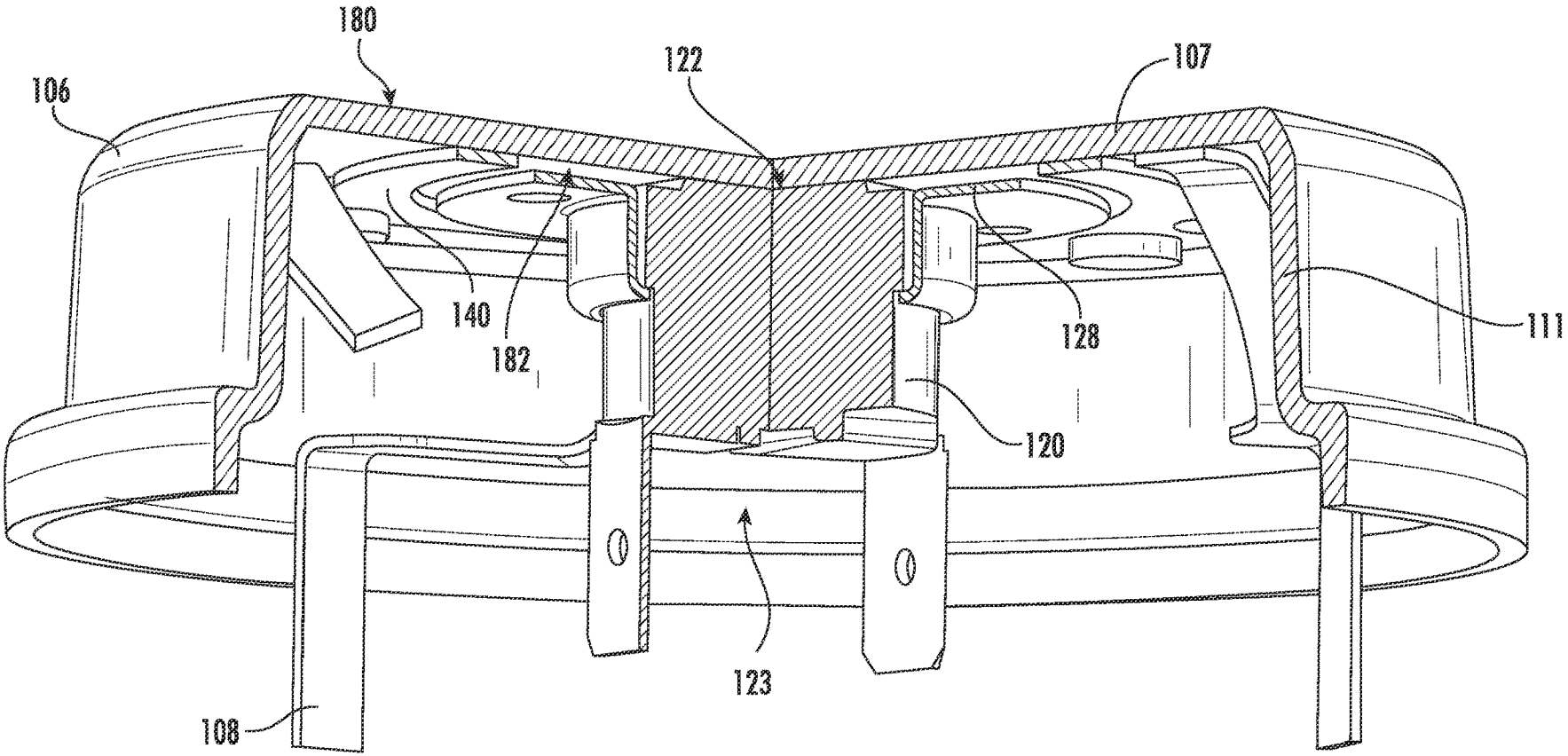
FIG. 7 provides a bi-sectional perspective view of a portion of the exemplary electric resistance heating coil assembly of FIG. 3.
Figure 8:
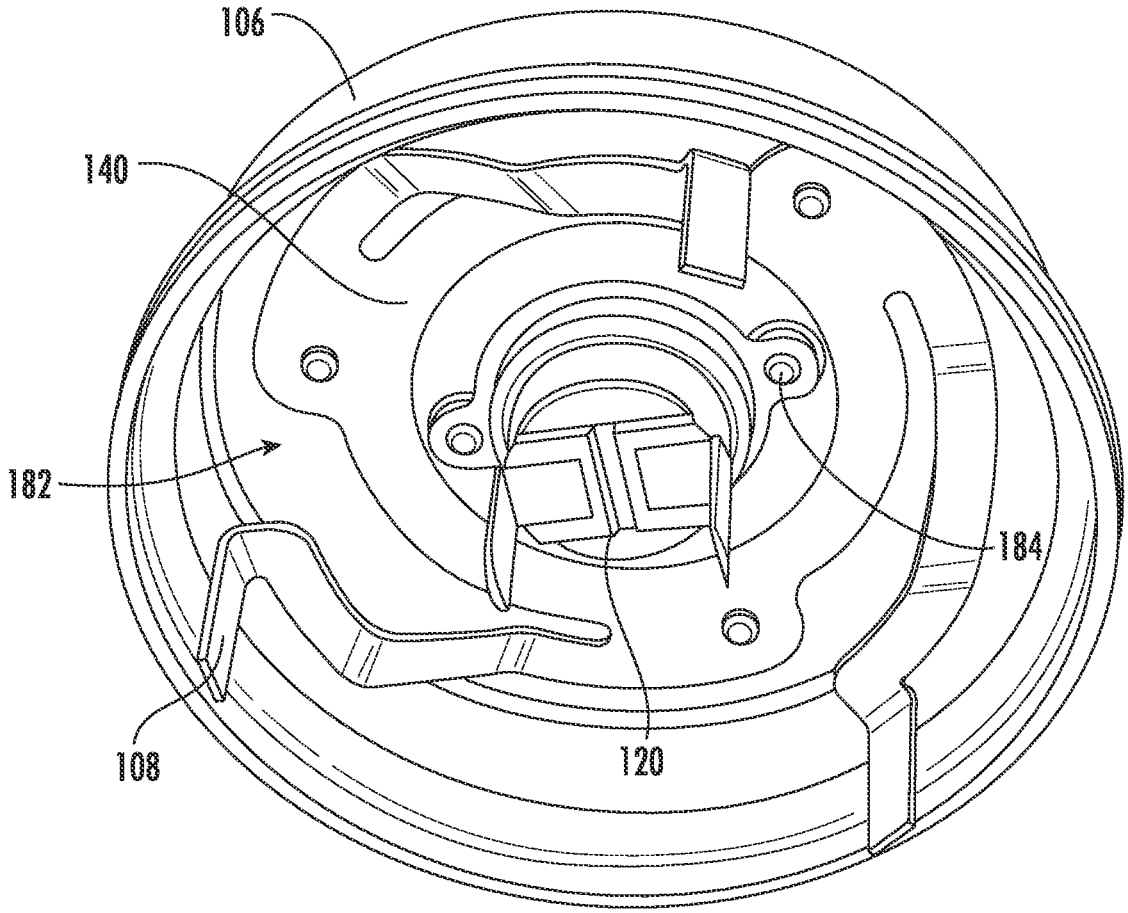
FIG. 8 provides a bottom perspective view of a portion of the exemplary heating coil assembly of FIG. 3.

Turning now to FIGS. 2 through 5, FIG. 2 provides a top perspective view of an electric resistance heating coil assembly 100 of range appliance 10. FIGS. 3 and 5 provide sectional views of electric resistance heating coil assembly 100. FIG. 4 provides an exploded perspective view of a portion of electric resistance heating coil assembly 100. Electric resistance heating coil assembly 100 may be used as one or more of heating elements 30 in range appliance 10. However, while described in greater detail below in the context of range appliance 10, it will be understood that electric resistance heating coil assembly 100 may be used in or with any suitable cooktop appliance in alternative example embodiments. As discussed in greater detail below, electric resistance heating coil assembly 100 includes features for facilitating conductive heat transfer between a thermostat (e.g., bimetallic thermostat 120) and a utensil positioned on electric resistance heating coil assembly 100.

As shown, some embodiments of electric resistance heating coil assembly 100 include a spiral wound sheathed heating element 110. Spiral wound sheathed heating element 110 may include a first coil section 112 and a second coil section 114. In certain embodiments, spiral wound sheathed heating element 110 also has a pair of terminals 116. Each of first and second coil sections 112, 114 may be directly coupled or connected to a respective terminal 116. A voltage differential across terminals 116 induces an electrical current through spiral wound sheathed heating element 110, and spiral wound sheathed heating element 110 may increase in temperature by resisting the electrical current through spiral wound sheathed heating element 110.

Within the heating zone 32, a sensor support assembly 101, including thermostat 120, is positioned. When assembled, bimetallic thermostat 120 is connected, for example, in series between first and second coil sections 112, 114 of spiral wound sheathed heating element 110. Bimetallic thermostat 120 opens and closes in response to a temperature of bimetallic thermostat 120. For example, bimetallic thermostat 120 may be spring loaded such that a distal end 122 of bimetallic thermostat 120 is urged away from a top surface 118 of spiral wound sheathed heating element 110. Thus, distal end 122 of bimetallic thermostat 120 may be urged towards a utensil (not shown) positioned on top surface 118 of spiral wound sheathed heating element 110. Bimetallic thermostat 120 may measure the temperature of the utensil on top surface 118 of spiral wound sheathed heating element 110 due to heat transfer between the utensil and bimetallic thermostat 120. As discussed in greater detail below, electric resistance heating coil assembly 100 includes features for facilitating conductive heat transfer between the utensil on top surface 118 of spiral wound sheathed heating element 110 and bimetallic thermostat 120.

Sensor support assembly 101 may also include a shroud 102 and coil support arms 104. Coil support arms 104 extend (e.g., radially) from shroud 102, and spiral wound sheathed heating element 110 is positioned on and supported by coil support arms 104. Coil support arms 104 may rest on top panel 20 to support electric resistance heating coil assembly 100 on top panel 20. A shroud cover 106 (i.e., conductive cap) may be disposed radially inward from the first and second coil sections 112, 114. For instance, shroud cover 106 may define an axial opening 109 (e.g., along an axial direction or parallel to vertical direction V) and may be positioned on or above shroud 102. Additionally or alternatively, shroud cover 106 may extend over shroud 102. In particular, a top of shroud 102 may be nested in shroud cover 106.

As shown, shroud cover 106 may include a top wall 107 and a sidewall 111 that extends downward from top wall 107. For instance, sidewall 111 may extend circumferentially about top wall 107 (e.g., at an outer perimeter thereof). Optionally, a nesting rim may be disposed on sidewall 111 (e.g., therebelow) or extend circumferentially around sidewall 111 to rest about shroud 102 and prevent shroud cover 106 from moving (e.g., radially) relative to shroud 102.

Nonetheless, when assembled, shroud cover 106 may generally be spaced apart from shroud 102. For instance, an air gap may be defined between shroud cover 106 and shroud 102 (e.g., such that contact or conductive thermal communication is prevented between the two).

Generally, top wall 107 of shroud cover 106 defines an upper surface 180 and a lower surface 182. When assembled, upper surface 180 faces upwards (e.g., to contact a utensil on electric resistance coil assembly 100. Lower surface 182 faces downwards (e.g., towards bimetallic thermostat 120 or shroud 102). When assembled, bimetallic thermostat 120 may be attached (e.g., fixed relative to) a portion of a shroud cover 106, as will be described in detail below. In particular, bimetallic thermostat 120 may be in conductive thermal communication (e.g., direct or indirect contact) with shroud cover 106 at lower surface 182 while "floating" within shroud 102. At least a portion of shroud cover 106 may be positioned above a top portion of thermostat 120 (e.g., distal end 122) and a bottom portion of thermostat 120 (e.g., an interior end 123 opposite of distal end 122). During use, shroud cover 106 generally facilitates or directs heat from a utensil thereon to bimetallic thermostat 120. Nonetheless, shroud 102 may shield bimetallic thermostat 120 from at least a portion of the heat generated at spiral wound sheathed heating element 110. Optionally, shroud 102 may be formed from a relatively low thermal conductivity metal (e.g., steel or a steel alloy). Additionally or alternatively, shroud cover 106 may be formed from a relatively high thermal conductivity metal (e.g., aluminum, copper, a copper alloy, or an aluminum alloy).

Figure 9:
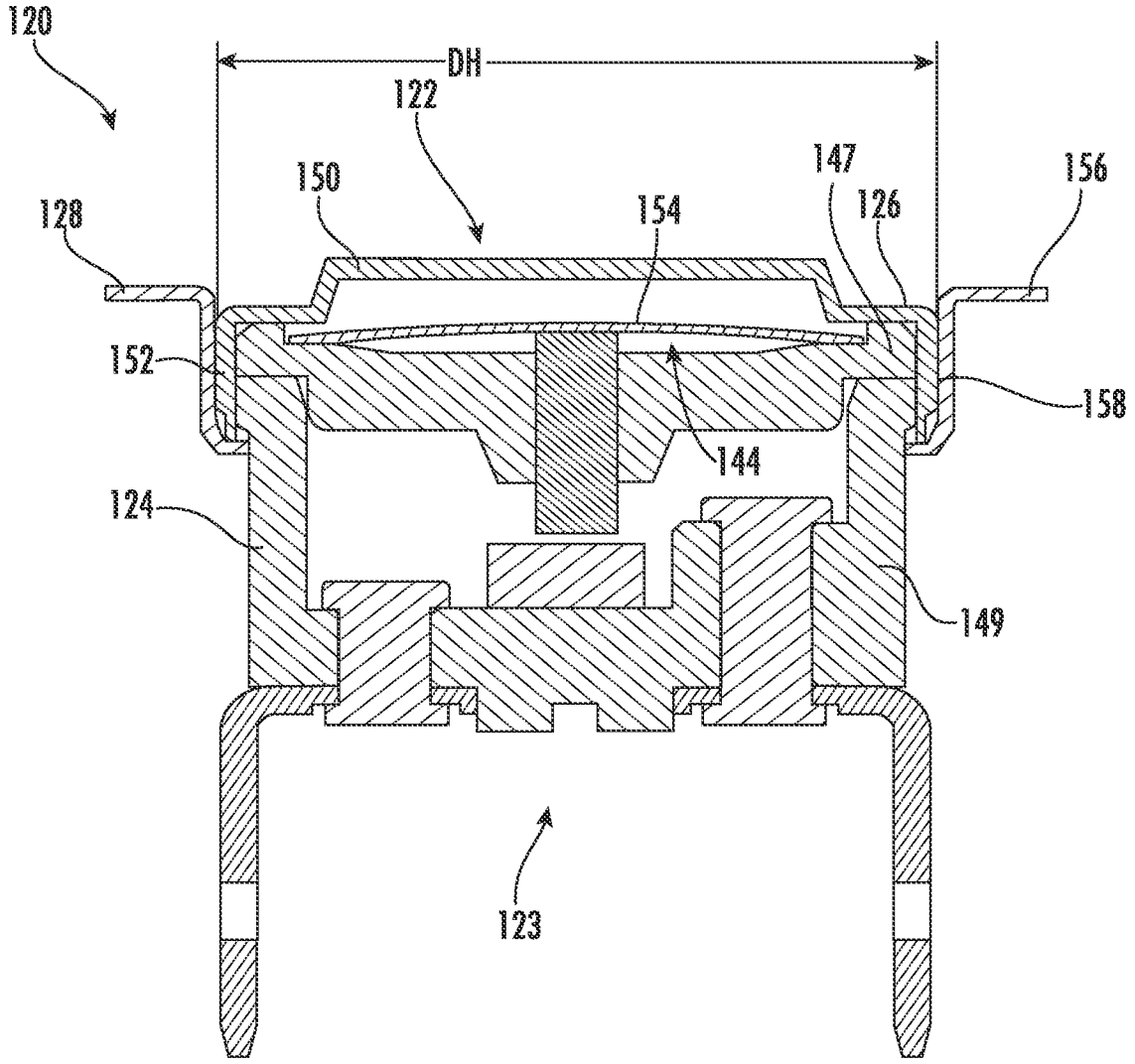
FIG. 9 provides a sectional view of a bimetallic thermostat of an electric resistance heating coil assembly according to exemplary embodiments of the present disclosure.

As shown, especially in FIG. 9, bimetallic thermostat 120 includes a discrete base 124 and top cap 126 that is held on base 124. For instance, at least a portion of top cap 126 may extend above base 124 and define an uppermost surface of bimetallic thermostat 120 at distal end 122. Thus, when assembled, top cap 126 may be fixed relative to shroud cover 106. In some embodiments, top cap 126 is press fitted on top of base 124. In additional or alternative embodiments, base 124 and top cap 126 are formed of, or include, distinct materials. For instance, base 124 may be formed from a substrate material, such as a thermally insulating or heat-resistant material (e.g., ceramic), while top cap 126 is formed from a second material, such as a relatively high thermal conductivity metal (e.g., aluminum, copper, a copper alloy, or an aluminum alloy). Top cap 126 may thus absorb and conduct heat faster or more readily than base 124. Optionally, top cap 126 may cover multiple segments of base 124, such as an upper frame 147 and a lower frame 149.

In some embodiments, top cap 126 includes an upper-facing surface 150 that extends across base 124 and a cap wall 152 that extends downwardly from upper-facing surface 150 around base 124. Optionally, base 124 may define a central opening 144 (e.g., within which a bimetallic disk 154 is disposed). Thus, the upper-facing surface 150 of top cap 126 may extend across and close central opening 144 while cap wall 152 contacts base 124, holding upper-facing surface 150 in place.

In certain embodiments, a support flange 128 of thermostat 120 extends radially from base 124 at distal end 122. For instance, support flange 128 may include an attachment lip 156 and a flange wall 158. As shown, attachment lip 156 may extend radially outward from base 124 (e.g., below shroud cover 106 or above flange wall 158). Optionally, flange wall 158 may be held to an outer surface of base 124 or top cap 126 proximal to distal end 122 (i.e., above the interior end 123 that is opposite the distal end 122). For instance, flange wall 158 may be press fitted to an upper portion of base 124. In some embodiments, support flange 128 is formed from a relatively high thermal conductivity metal (e.g., aluminum, copper, a copper alloy, or an aluminum alloy).

Returning generally to FIGS. 3 through 9, a spring bracket 108 biases shroud cover 106 upwardly. As shown, spring bracket 108 may include a mounting plate 140 and one or more biasing arms 142 extending therefrom. Spring bracket 108 (e.g., at mounting plate 140) may define a central recess 143 within which thermostat 120 may be held or nested. When assembled, shroud cover 106 is supported on or attached to mounting plate 140. For instance, shroud cover 106 may rest directly on mounting plate 140. Additionally or alternatively, shroud cover 106 may be attached to mounting plate 140. For instance, mounting plate 140 can be welded, clipped, or otherwise attached to lower surface 182 of shroud cover 106 with mechanical fasteners (e.g., screws, rivets, stud welding, mated threading, etc.), or a combination thereof. In some such embodiments, one or more support stakes 170 may extend downward from lower surface 182 and be joined (e.g., via one or more rivets, screws, or other suitable mechanical fasteners) to mounting plate 140. Because top wall 107 is positioned on mounting plate 140, shroud cover 106 may also be urged away from top surface 118 of spiral wound sheathed heating element 110.

Biasing arms 142 may be resilient members, which generally urge mounting plate 140 upward. Spring bracket 108, including biasing arms 142, may be formed from any suitable high temperature material. For instance, spring bracket 108 is formed of a stainless steel, full hard, or spring tempered material. Spring bracket 108 can be formed of other suitable high temperature materials as well.

During use, top wall 107 of shroud cover 106 may generally act as a heat transfer disk to transfer heat through top wall 107 from upper surface 180 to lower surface 182. As shown, top wall 107 is positioned on bimetallic thermostat 120 at distal end 122 of bimetallic thermostat 120. In particular, distal end 122 may be held against the lower surface 182 of top wall 107. Optionally, lower surface 182 may contact distal end 122 at the upper-facing surface 150. Thus, top wall 107 may be in direct, thermal, conductive communication with bimetallic thermostat 120 at lower surface 182.

Shroud cover 106 or bimetallic thermostat 120 may be positioned concentrically with a center 119 of spiral wound sheathed heating element 110. Center 119 of spiral wound sheathed heating element 110 may be open, and spiral wound sheathed heating element 110 may extend circumferentially around heat shroud cover 106 or bimetallic thermostat 120 at center 119.

Generally, top wall 107 may be sized to facilitate conductive heat transfer between a utensil on top surface 118 of spiral wound sheathed heating element 110 and bimetallic thermostat 120. For example, a diameter DH of top wall 107 may be larger than a diameter DT of top cap 126 of bimetallic thermostat 120 (e.g., in a plane that is perpendicular to the vertical direction V). Additionally or alternatively, diameter DH of top wall 107 may be larger than a maximum diameter DB defined by base 124 of bimetallic thermostat 120 (e.g., no less than two times greater in a plane that is perpendicular to the vertical direction V). Additionally or alternatively, the diameter DH of top wall 107 may be less than a diameter DC (FIG. 2) of center 119 of spiral wound sheathed heating element 110. The sizing of top wall 107 relative to bimetallic thermostat 120 may advantageously assist conductive heat transfer from the utensil on top surface 118 of spiral wound sheathed heating element 110 to bimetallic thermostat 120. Thickness TH of top wall 107 may be constant or, alternatively, variable.

As shown, thermostat 120 may be attached directly to top wall 107. Specifically, lower surface 182 may be attached (e.g., directly) to thermostat 120 at distal end 122 (e.g., at upper-facing surface 150). For instance, bimetallic thermostat 120 can be welded, clipped, or otherwise attached to lower surface 182 of shroud cover 106 with mechanical fasteners (e.g., screws, rivets, weld studs, mated threading, etc.), or a combination thereof. In some such embodiments, support flange 128 is joined to shroud cover 106 at lower surface 182 via one or more mechanical fasteners.

As an example, one or more attachment posts 184 may each extend through a corresponding connection aperture defined along the vertical direction V through support flange 128 and connect to shroud cover 106 (e.g., at the lower surface 182). When assembled, the attachment posts 184 may be, for example, friction welded, spot welded, seam welded, ultrasonic welded, or resistance welded to shroud cover 106; and hold support flange 128 to shroud cover 106. Optionally, attachment posts 184 may include or be integrally formed from the same material as shroud cover 106.

As an additional or alternative example, thermostat 120 (e.g., at top cap 126 or support flange 128) may be friction welded, spot welded, seam welded, ultrasonic welded, or resistance welded to shroud cover 106. In certain embodiments, shroud cover 106 and top cap 126 or support flange 128 may be formed from a common material, such as one of aluminum, copper, a copper alloy, or an aluminum alloy, in order to advantageously facilitate conductive heat transfer between bimetallic thermostat 120 and shroud cover 106 or (additionally or alternatively) facilitate the joining of bimetallic thermostat 120 to shroud cover 106.

Figure 10:
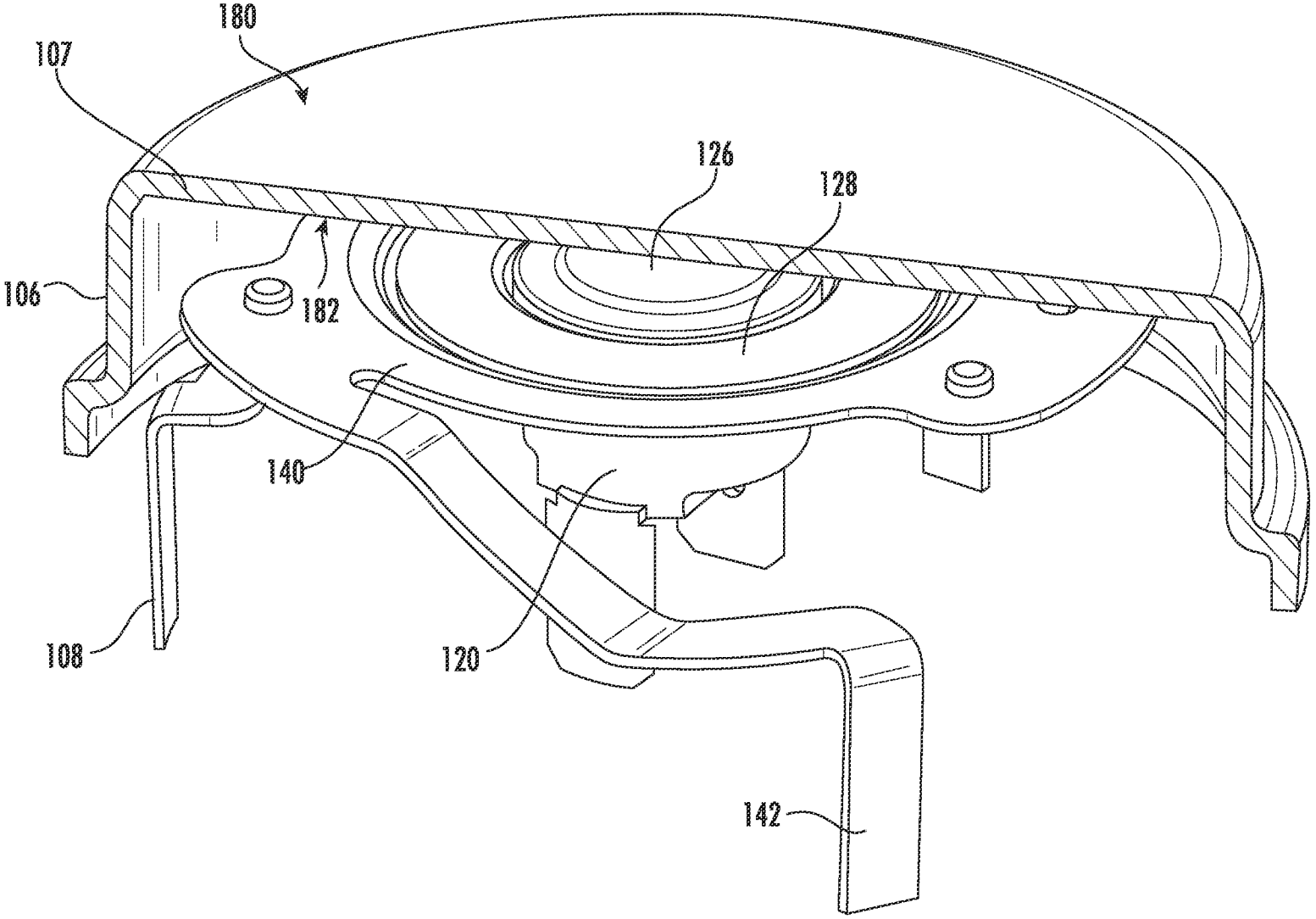
FIG. 10 provides a partially-exploded view of a portion of an electric resistance heating coil assembly according to exemplary embodiments of the present disclosure, wherein a shroud cover has been provided as a cross-section for the purposes of clarity.
Figure 11:
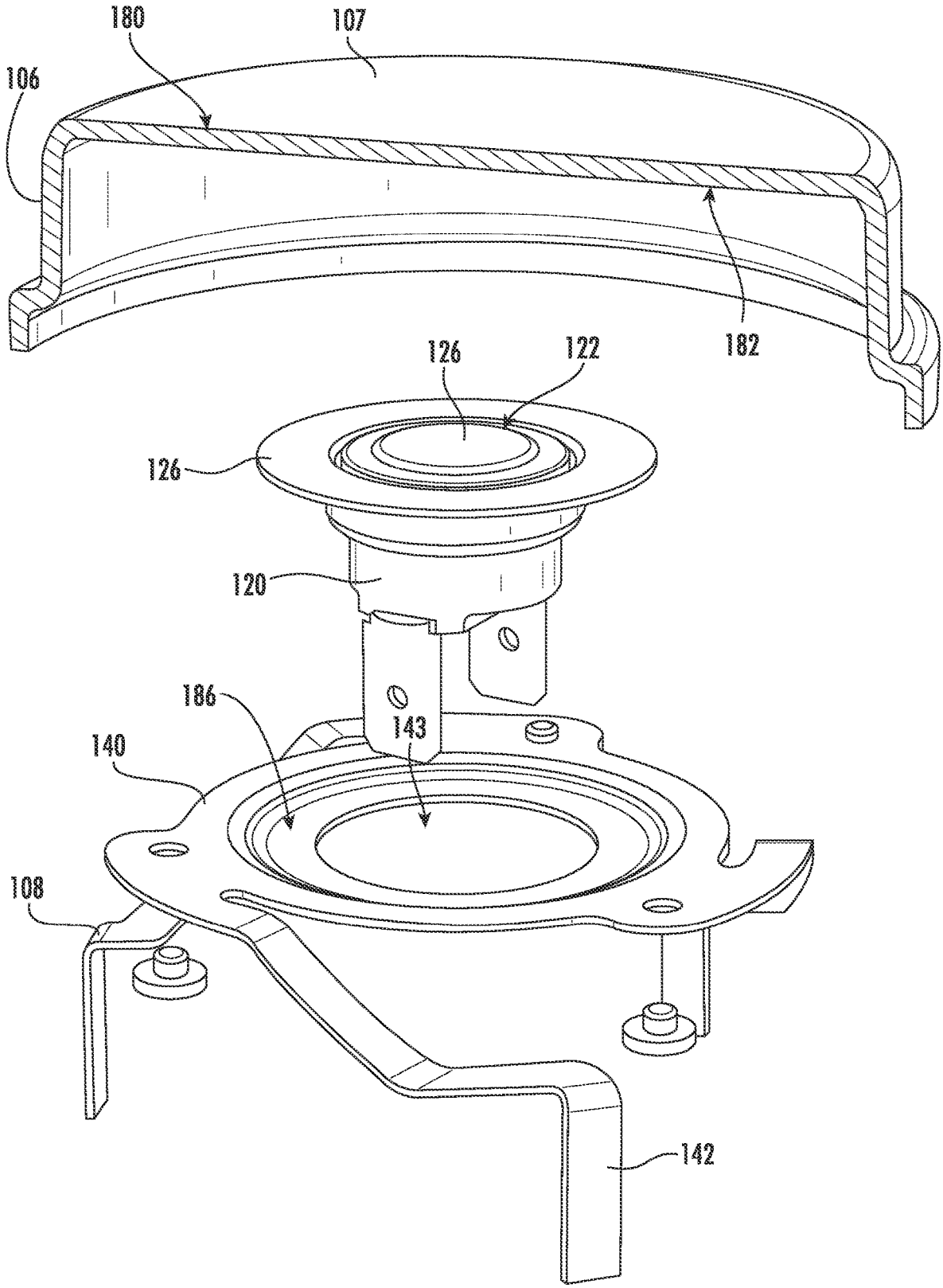
FIG. 11 provides an exploded view of the exemplary portion of the electric resistance heating coil assembly of FIG. 10.
Figure 12:
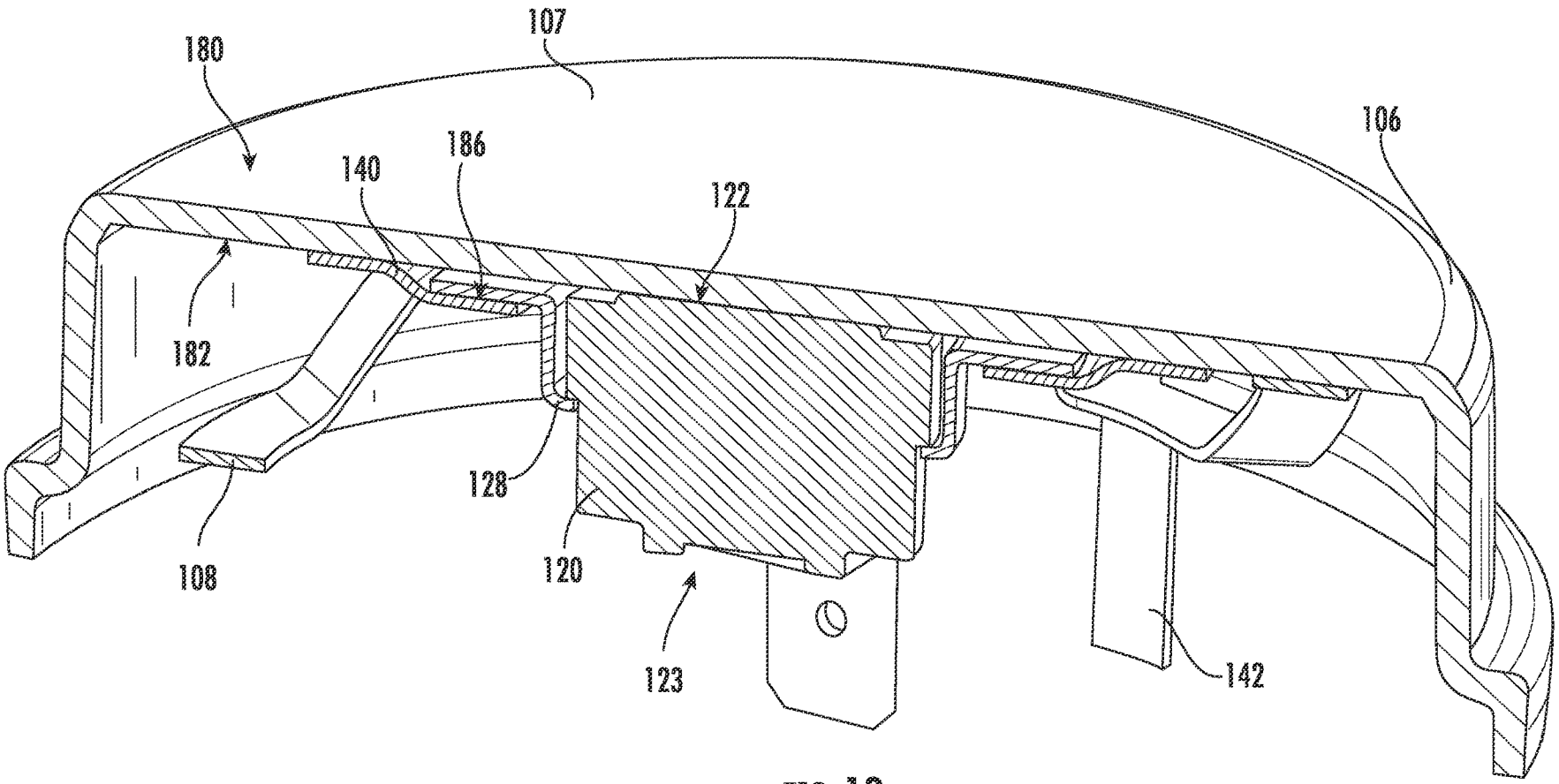
FIG. 12 provides a sectional perspective view of the exemplary portion of the electric resistance heating coil assembly of FIG. 10.

Turning now to FIGS. 10 through 12, another exemplary embodiment of an assembly including thermostat 120, spring bracket 108, and shroud cover 106 is illustrated. It is noted that, except as otherwise indicated, such embodiments include some or all of the features of the above described embodiments.

In some embodiments, thermostat 120 is supported directly on spring bracket 108. Specifically, thermostat 120 may be supported on mounting plate 140. In some such embodiments, mounting plate 140 defines a sunken groove 186 about a central recess 143. Thermostat 120 may be received through the central recess 143 and rest on sunken groove 186. Thus, interior end 123 may be disposed below mounting plate 140 while distal end 122 is disposed above at least a portion of mounting plate 140 (e.g., a bottom facing surface of mounting plate 140). In some such embodiments, support flange 128 is held within sunken groove 186. For instance, attachment lip 156 may sit on top of or within sunken groove 186 (e.g., at an upward facing surface of mounting plate 140). As described above, mounting plate 140 may be attached to shroud cover 106 at lower surface 182. When assembled, distal end 122 of thermostat 120 may thus be sandwiched or pinned between mounting plate 140 (e.g., at sunken groove 186) and lower surface 182 of shroud cover 106. Thus, distal end 122 may be in contact with top wall 107 (e.g., at lower surface 182).

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An electric resistance heating coil assembly, comprising:

a spiral wound sheathed heating element having a first coil section and a second coil section;

a shroud cover disposed radially inward from the first and second coil sections, the shroud cover comprising a top wall defining an upper surface and a lower surface;

a thermostat extending vertically between a distal end and an interior end below the distal end, the distal end being disposed against the shroud cover at the lower surface, the thermostat being connected in series between the first and second coil sections of the spiral wound sheathed heating element; and a spring bracket disposed against the shroud cover at the lower surface and biasing the shroud cover upward, wherein the thermostat comprises a base defining a central opening and a top cap extending across and closing the base at the distal end.

2. The electric resistance heating coil assembly of claim 1, wherein the shroud cover comprises aluminum.

3. The electric resistance heating coil assembly of claim 1, wherein the spring bracket comprises steel.

4. The electric resistance heating coil assembly of claim 1, further comprising:

a shroud surrounding the thermostat at the interior end.

5. The electric resistance heating coil assembly of claim 4, wherein the shroud cover comprises aluminum, and wherein the shroud comprises steel.

6. The electric resistance heating coil assembly of claim 1, wherein the top cap is fixed in direct contact with the lower surface.

7. The electric resistance heating coil assembly of claim 1, wherein the thermostat comprises a support flange extending radially from the base at the distal end, and wherein the support flange is joined to the shroud cover at the lower surface.

8. The electric resistance heating coil assembly of claim 1, wherein the thermostat is supported on the spring bracket.

9. The electric resistance heating coil assembly of claim 8, wherein the spring bracket comprises a mounting plate and one or more biasing arms extending therefrom, wherein the mounting plate defines a central recess, wherein the thermostat comprises a support flange extending radially from the base of the thermostat at the distal end, and wherein the support flange is nested within the central recess.

10. The electric resistance heating coil assembly of claim 1, wherein the distal end of the thermostat is disposed below the upper surface of the top wall.

11. A cooktop appliance, comprising:

a heating element defining a heating zone; and a sensor support assembly positioned within the heating zone of the heating element, the sensor support assembly comprising a shroud cover comprising a top wall defining an upper surface to contact a cooking utensil and a lower surface disposed opposite of the upper surface, a thermostat fixed relative to the shroud cover below the upper surface, and a spring bracket disposed against the shroud cover at the lower surface and biasing the shroud cover upward, wherein the thermostat comprises a base defining a central opening and a top cap extending across and closing the base at a distal end of the thermostat.

12. The cooktop appliance of claim 11, wherein the shroud cover comprises aluminum.

13. The cooktop appliance of claim 11, wherein the spring bracket comprises steel.

14. The cooktop appliance of claim 11, wherein the sensor support assembly further comprises a shroud surrounding the thermostat at an interior end of the thermostat.

15. The cooktop appliance of claim 14, wherein the shroud cover comprises aluminum, and wherein the shroud comprises steel.

16. The cooktop appliance of claim 11, wherein the top cap is fixed in direct contact with the lower surface.

17. The cooktop appliance of claim 11, wherein the thermostat comprises a support flange extending radially from the base of the thermostat at the distal end, and wherein the support flange is joined to the shroud cover at the lower surface.

18. The cooktop appliance of claim 11, wherein the thermostat is supported on the spring bracket.

19. The cooktop appliance of claim 18, wherein the spring bracket comprises a mounting plate and one or more biasing arms extending therefrom, wherein the mounting plate defines a central recess, wherein the thermostat comprises a support flange extending radially from the base at the distal end, and wherein the support flange is nested within the central recess.

20. The cooktop appliance of claim 11, wherein the distal end of the thermostat is disposed below the upper surface of the top wall.

* * * * *